US010480770B2

(12) United States Patent
Hierzer

(10) Patent No.: US 10,480,770 B2
(45) Date of Patent: Nov. 19, 2019

(54) LAMP

(71) Applicant: H4X e.U., Graz (AT)

(72) Inventor: Andreas Hierzer, Graz (AT)

(73) Assignee: H4X e.U., Graz (AT)

( * ) Notice: Subject to any disclaimer, the term of this patent is extended or adjusted under 35 U.S.C. 154(b) by 225 days.

(21) Appl. No.: 15/453,936

(22) Filed: Mar. 9, 2017

(65) Prior Publication Data

US 2017/0261195 A1 Sep. 14, 2017

(30) Foreign Application Priority Data

Mar. 10, 2016 (DE) ..... 10 2016 203 920

(51) Int. Cl.

| | |
|---|---|
| ***F21V 29/87*** | (2015.01) |
| ***F21V 29/70*** | (2015.01) |
| ***F21V 15/01*** | (2006.01) |
| ***F21V 19/00*** | (2006.01) |
| ***F21Y 115/10*** | (2016.01) |

(52) U.S. Cl.

CPC ..... *F21V 29/87* (2015.01); *F21V 15/01* (2013.01); *F21V 19/003* (2013.01); *F21V 29/70* (2015.01); *F21Y 2115/10* (2016.08)

(58) Field of Classification Search

None

See application file for complete search history.

(56) References Cited

U.S. PATENT DOCUMENTS

| | | | | |
|---|---|---|---|---|
| 7,365,988 | B2 * | 4/2008 | Reis | H04N 5/2256 257/706 |
| 7,625,104 | B2 * | 12/2009 | Zhang | F21K 9/00 362/294 |
| 7,758,223 | B2 * | 7/2010 | Osawa | F21V 3/00 362/547 |
| 8,038,329 | B2 * | 10/2011 | Takahasi | F21V 3/00 362/264 |

(Continued)

FOREIGN PATENT DOCUMENTS

| | | | |
|---|---|---|---|
| DE | 102008039364 | A1 | 3/2010 |
| DE | 202010009679 | U1 | 10/2010 |

(Continued)

OTHER PUBLICATIONS

European Search Report dated May 17, 2017 issued in corresponding EP 17156266.3 application (7 pages).

(Continued)

*Primary Examiner* — Britt D Hanley

(74) *Attorney, Agent, or Firm* — Millen, White, Zelano & Branigan, P.C.; William Nixon

(57) ABSTRACT

A lamp is disclosed, which has a lamp housing, having an end wall and a side wall, a lighting means device arranged in a housing interior having a lighting means carrier and at least one lighting means arranged thereon, an insulation component formed from an electrically insulating material having a main portion and an edging portion, wherein the main portion is arranged between the end wall and the lighting means device and wherein the edging portion (Continued)

extends from the main portion in such a way that the edging portion is arranged between the lighting means device and the side wall of the lamp housing.

14 Claims, 4 Drawing Sheets

(56) References Cited

U.S. PATENT DOCUMENTS

| | | | | |
|---|---|---|---|---|
| 8,388,183 | B2 * | 3/2013 | Miki | F21V 3/00 362/249.02 |
| 8,405,288 | B2 | 3/2013 | Tsai | |
| 9,028,086 | B2 | 5/2015 | Woo et al. | |
| 9,989,221 | B2 | 6/2018 | Yamamoto | |
| 2006/0098440 | A1 * | 5/2006 | Allen | F21V 3/00 362/294 |
| 2007/0236935 | A1 * | 10/2007 | Wang | F21K 9/00 362/294 |
| 2010/0026157 | A1 * | 2/2010 | Tanaka | F21V 19/0055 313/45 |
| 2010/0097811 | A1 * | 4/2010 | Betsuda | F21V 23/002 362/362 |
| 2011/0248615 | A1 | 10/2011 | Tsai | |
| 2012/0140442 | A1 | 6/2012 | Woo et al. | |
| 2012/0281400 | A1 | 11/2012 | Ou et al. | |
| 2015/0070913 | A1 | 3/2015 | Yamamoto | |

FOREIGN PATENT DOCUMENTS

| | | | |
|---|---|---|---|
| DE | 102012215934 | A1 | 3/2014 |
| EP | 2157358 | A2 | 2/2010 |
| EP | 2461094 | A2 | 6/2012 |
| EP | 2837880 | A1 | 2/2015 |

OTHER PUBLICATIONS

English Abstract of EP 2157358 A2 published Feb. 24, 2010.
English Abstract of EP 2157358 A2 corresponding to DE 102008039364 A1 published Mar. 4, 2010.
English Abstract of DE 102012215934 A1 published Mar. 13, 2014.

* cited by examiner

LAMP

FIELD OF THE INVENTION

The present invention relates to a lamp, in particular to a lamp for illuminating a room in a building.

BACKGROUND

Lamps are known from the general prior art, in which lighting means arranged on a lighting means carrier are operated by an operating voltage. The operating voltage is generally provided by an electronic ballast connected to the power supply, said ballast being arranged within a housing of the lamp and having a corresponding electrical insulation in relation to a housing.

To transport heat out of the housing, lamps are known, in which the ballast is surrounded by a paste-like heat-conducting material, which connects the ballast to the housing.

SUMMARY OF THE INVENTION

An idea of the present invention is to provide a lamp having a compact structure with efficient heat removal.

According to some embodiments of the invention, a lamp is provided, which comprises a lamp housing, having an end wall and a side wall, wherein the end wall and the side wall form a housing interior. The lamp furthermore comprises a lighting means device arranged in the housing interior having a lighting means carrier and at least one lighting means arranged thereon. Moreover, the lamp has an insulation component, formed from an electrically insulating material, having a main portion and an edging portion, the main portion being arranged between the end wall and the lighting means device and the edging portion extending from the main portion, transversely thereto, in such a way that the edging portion is arranged between the lighting means device and the side wall of the lamp housing.

The lighting means device can be operated by an electrical operating voltage, light being able to be emitted by the at least one lighting means. In particular, the lighting means device is arranged in the housing interior in such a way that the at least one lighting means is situated facing a light outlet opening of the lamp housing.

The lighting means device is screened in an electrically insulating manner from the lamp housing by the insulation component. This has the advantage that the spacing between the lighting means device and the lamp housing can be very small without a current flow being produced between the lighting means device and housing during operation of the lamp. This achieves a particularly compact structure of the lamp. In particular, the lighting means device can thereby also be advantageously operated by large operating voltages.

The side wall of the lamp housing extends in particular transversely to the end wall and along a lamp longitudinal direction. The lamp housing is generally formed from a metal material and for example from an aluminum material.

The main portion of the insulation component is for example plate-shaped or disc-shaped and extends in a planar manner transversely to the side wall of the lamp housing or transversely to the lamp longitudinal direction. In particular, the insulation component extends, at least in portions, along the end wall of the lamp housing. The edging portion of the insulation component extends from the main portion of the insulation component and transversely thereto.

It may be provided that the main portion of the insulation component has a recess and the lighting means device is arranged on the main portion of the insulation component in such a way that a lighting means region of the lighting means carrier, in which the at least one lighting means is arranged, and the recess of the main portion of the insulation component at least partially overlap. In particular, the recess of the main portion of the insulation component and the lighting means region of the lighting means device overlap, at least partially or in regions, in relation to a radial direction directed transversely to the lamp longitudinal direction.

This overlapping of the lighting means region and the recess of the main portion has the advantage that the thermal resistance between the lamp housing and the lighting means device is reduced in the region of the lighting means, so that an efficient heat transfer from the lighting means device to the lamp housing is achieved.

The edging portion of the insulation component may, in particular, have an at least partially curved cross-sectional course.

Furthermore, it may be provided that the lighting means device and the insulation component are connected to the end wall of the lamp housing by means of a clamping mechanism. For this purpose, the clamping mechanism can be prestressed between an attachment point, which is situated on the side wall of the lamp housing, and the lighting means carrier of the lighting means device. The prestressing of the clamping mechanism can be achieved in that it is formed from a resiliently deformable material and it is clamped between the attachment point and the lighting means carrier in such a way that the material of the clamping mechanism is resiliently deformed, at least in individual regions or portions. The prestressing can also be applied by applying a pressing force, for example by means of an adapter component, which latches or is screwed into the attachment point.

As an alternative or in addition to the clamping mechanism, it may be provided that the lighting means device and the insulation component are connected to the end wall of the lamp housing by means of fastening elements extending through the lighting means carrier and the main portion of the insulation component, the fastening elements being edged by an insulation sleeve. The fastening elements may be formed, for example by screws, rivets, pins or the like.

The insulation component may, in particular, be formed from a polybutylene terephthalate material. This material has the advantage that it has a high dielectric strength, for example greater than or equal to 4 kV/mm and, at the same time, can be economically processed using a vacuum forming process. Materials of this type also have high heat resistance, for example they can be used at temperatures of more than 105 degrees Celsius. Polybutylene terephthalate materials also satisfy the requirements of FR-1 ("flame retardant 1") material with respect to flammability and dielectric strength.

Furthermore, the lamp may comprise a heat conduction component, which is formed from an electrically insulating material and is arranged between the lighting means device and the insulation component or between the insulation component and the end wall of the lamp housing. If the lighting means device and the insulation component are fastened by means of fastening elements, it may be provided that the heat conduction component has corresponding through-bores, through which the fastening elements extend.

The heat conduction component is advantageously configured from an electrically insulating material having high heat conductivity. The material may, in particular, be resiliently deformable and has a heat conductivity of greater than or equal to 1 W/mK and a dielectric strength of greater than or equal to 4 kV/mm. A large contact face between the heat conduction component and end face and heat conduction component and insulation component or heat conduction component and lighting means device is achieved by the deformability of the material of the heat conduction component. As a result, an efficient heat removal from the lighting means device to the lamp housing is ensured.

With a high dielectric strength of the lighting means carrier of the lighting means device, the heat conduction component can also be formed from a material with lower dielectric strength.

The heat conduction component may have a thickness in a range between 0.1 mm and 10 mm, for example between 0.2 mm and 5 mm and for example between 0.3 mm and 3 mm. This thickness is produced in a state in which the heat conduction part is installed in the lamp and is optionally compressed by the insulation part and the end wall or the lighting means carrier and the insulation part or the lighting means carrier and the end wall. On the one hand, this ensures that the lighting means device is spaced apart from the end wall of the lamp housing, so that the danger of an unintentional electrical current flow, such as leakage currents or the like, between the lighting means device and the housing is reduced. At the same time, in this thickness range, high heat flows can be transferred from the lighting means device to the lamp housing.

The at least one lighting means may be integrated on the lighting means carrier in such a way that the lighting means device is configured as a chip-on-board LED module, for short COB-LED module, or as a PCBA-LED module, short for "printed circuit board assembly LED module".

Both in COB-LED modules and in PCBA-LED modules, the lighting means carrier is formed from a carrier substrate, for example as a ceramic or aluminum carrier. In an aluminum carrier, an insulation layer of an electrically insulating material is additionally provided.

In COB-LED modules, one or more lighting means in the form of LED elements are generally arranged directly on the lighting means carrier. The LED elements may additionally be covered by a phosphorus layer. In a PCBA-LED module, a plurality of LED elements is in each case combined to form an LED unit and are soldered to the lighting means carrier.

In this case, the lighting means device may, for example, be round, rectangular or polygonal in a plan view of the lighting means carrier. The lighting means may be arranged suitably distributed on the carrier substrate.

The lighting means device may generally be designed so that it can be operated at an operating voltage of greater than or equal to 90 volts. The lighting means device can particularly advantageously be operated at an operating voltage in a range between 90 volts and 380 volts. This range is therefore above safety extra-low voltages and comprises, in particular, the voltages that are generally provided in public supply voltages as connection voltages. This has the advantage that the lighting means device can be operated without an additional electronic ballast which converts the voltage provided by the power supply into an operating voltage to operate the lighting means device. The structure of the lamp thus becomes more compact overall.

In general, the lighting means device can be operated using a direct voltage and/or an alternating voltage.

In relation to direction details and axes, in particular to direction details and axes relating to the course of physical structures, a course of an axis, a direction or a structure "along" another axis, direction or structure is herein taken to mean that these, in particular the tangents being produced in a respective point of the structures, in each case run at an angle of less than or equal to 45 degrees, for example less than or equal to 30 degrees and for example parallel to one another.

In relation to direction details and axes, in particular to direction details and axes relating to the course of physical structures, a course of an axis, a direction or a structure "transverse" to another axis, direction or structure is herein taken to mean that these, in particular the tangents being produced in a respective point of the structures, in each case run at an angle of greater than 45 degrees, for example greater than or equal to 60 degrees and for example perpendicular to one another.

BRIEF DESCRIPTION OF THE DRAWINGS

Embodiments of the invention are shown in the drawings and are described in more detail in the following description. In the drawings.

DETAILED DESCRIPTION OF THE EMBODIMENTS

Figure 1:
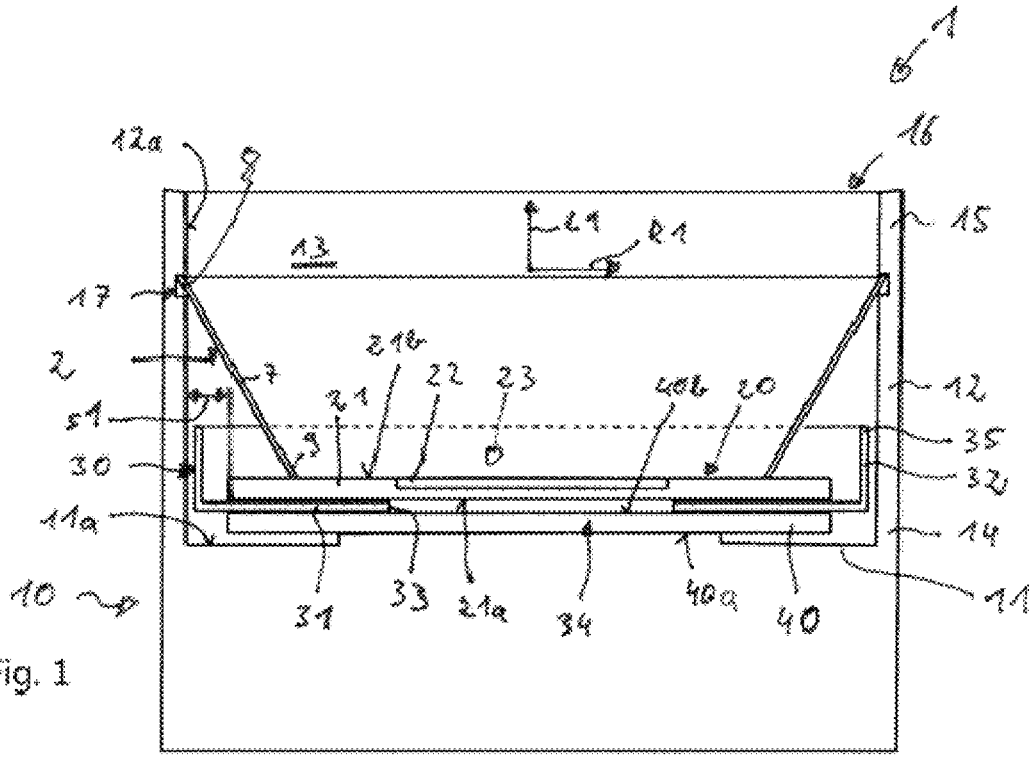
FIG. 1 is a schematic sectional view of a lamp according to an embodiment of the present invention.

FIG. 1 schematically shows a sectional view of an embodiment of a lamp 1 according to the invention. The lamp 1 comprises a lamp housing 10 having an end wall 11 and a side wall 12, the end wall 11 and the side wall 12 forming a housing interior 13. The side wall 12 extends, in particular, from the end wall 11 and runs along a lamp longitudinal direction L1. The side wall 12 has a first end portion 14 connected to the end wall 11 and a second end portion 15 situated opposite the first end portion 14.

The housing interior 13 is, in particular, defined by mutually facing surfaces of the side wall 12 and the end wall 11. In particular, an end surface 11*a* of the end wall 11 and an internal face 12*a* of the side wall 12 define the housing interior 13. The housing interior has a light outlet opening 16 defined by the side wall 12, in particular by the second end portion 15 of the side wall 12.

The end wall 11 and the side wall 12 may, for example, be configured as one piece. Alternatively, the side wall 12 and the end wall 11 may also be configured as two separate parts. The side wall 12 may be connected here by its first end portion 14 to the end wall 11, in particular to the end surface 11*a* of the end wall 11, for example by welding, gluing or the like. The end wall 11 and the side wall 12 are for example formed from a material with high heat conductivity, such as, for example, aluminum, an aluminum alloy or the like. The light housing 10 thus forms a heat sink for waste heat occurring during operation of a lighting means device 20 arranged in the housing interior 13 of the lamp housing 10 and described in more detail below.

The lamp 1 furthermore comprises a lighting means device 20 arranged in the housing interior 13. Said lighting means device generally comprises a lighting means carrier 21, which may, in particular, be disc-shaped or plate-shaped, and at least one lighting means 22 arranged thereon. The lighting means device 20 for example comprises a large number of lighting means 22 or lighting elements, which are not shown individually in FIGS. 1 to 4. The lighting elements or lighting means 22 may, for example, be arranged in the form of light-emitting diodes, for short LEDs, on the lighting means carrier 21, or integrated thereon.

The at least one lighting means 22 may advantageously be arranged on the lighting means carrier 21 in such a way that the lighting means device 20 is configured as a chip-on-board LED module or as a PCBA-LED module.

Figure 5:
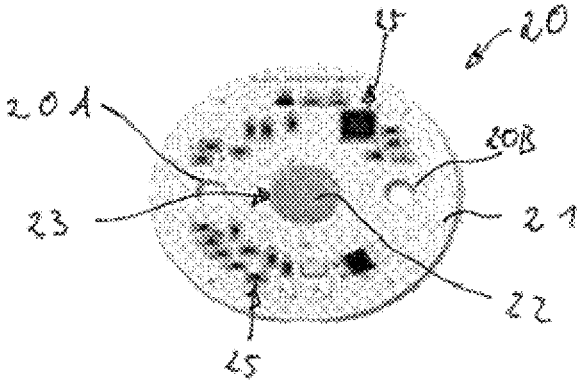
FIG. 5 shows an embodiment of a lighting means device of the lamp according to the present invention.

FIG. 5 shows, by way of example, an embodiment of a lighting means device realized as a chip-on-board LED module, for short COB-LED module. In the example of the COB-LED module shown in FIG. 5, a planar lighting means 22 in the form of LED elements is arranged directly on the lighting means carrier 21. The lighting means 22 is round in this case. The lighting means 22 may, however, also have a rectangular or polygonal or similar shape. The lighting means carrier 21 is round according to FIG. 5. Said lighting means carrier may, for example, also be rectangular or polygonal.

Figure 6:
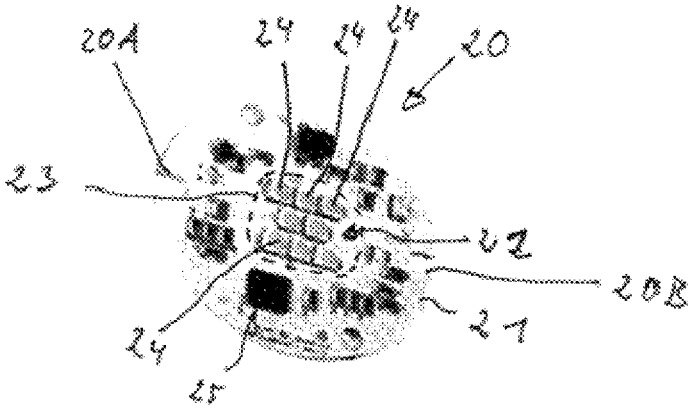
FIG. 6 shows a further embodiment of a lighting means device of the lamp according to the present invention.

By way of example, FIG. 6 shows a lighting means device, which is configured as a PCBA-LED module, short for "printed circuit board assembly LED module". The lighting means 22 in the form of LED units 24, which in each case comprise a plurality of LED elements, are soldered here on the lighting means carrier 21. The lighting means 22 may be arranged suitably distributed on the carrier substrate, for example as shown in FIG. 6, in rows. The lighting means carrier 21 is round according to FIG. 6. Said lighting means carrier may, for example, also be rectangular or polygonal.

As shown in FIGS. 5 and 6, the lighting means devices 20 may in each case have further electronic switching components 25, which will not be dealt with in more detail below.

Figure 2:
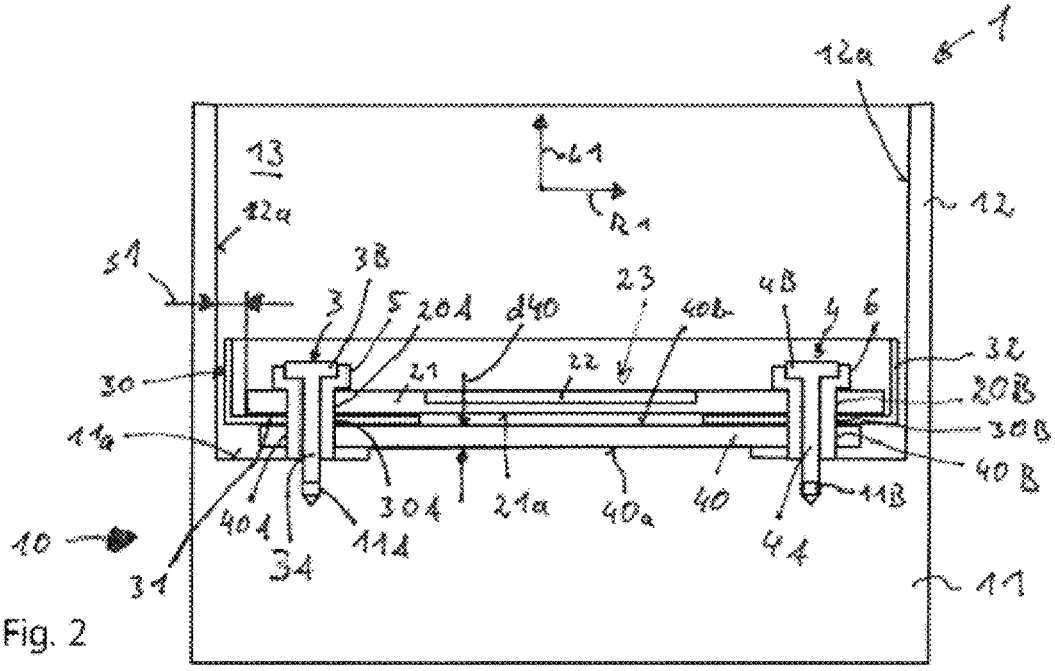
FIG. 2 is a schematic sectional view of a lamp according to a further embodiment of the present invention.

As shown, in particular in FIGS. 1 and 2, the lighting means 22 may be arranged in general in a lighting means region 23 of the lighting means carrier 21. For example, planar, concentric, row-shaped or matrix-shaped arrangements of the lighting means 22 may be provided.

The lighting means device 20 may be designed such that it is able to be operated by an operating voltage of greater than or equal to 90 volts. Advantageously, the lighting means device 20 may be able to be operated by an operating voltage that can be operated in a range between 90 volts and 380 volts. This range comprises in particular the voltages, which are generally provided in public power supplies as connection voltages. This has the advantage that the lighting means device 20 can be operated without an additional electronic ballast, which converts the voltage provided by the power supply to an operating voltage to operate the lighting means device.

Figure 4:
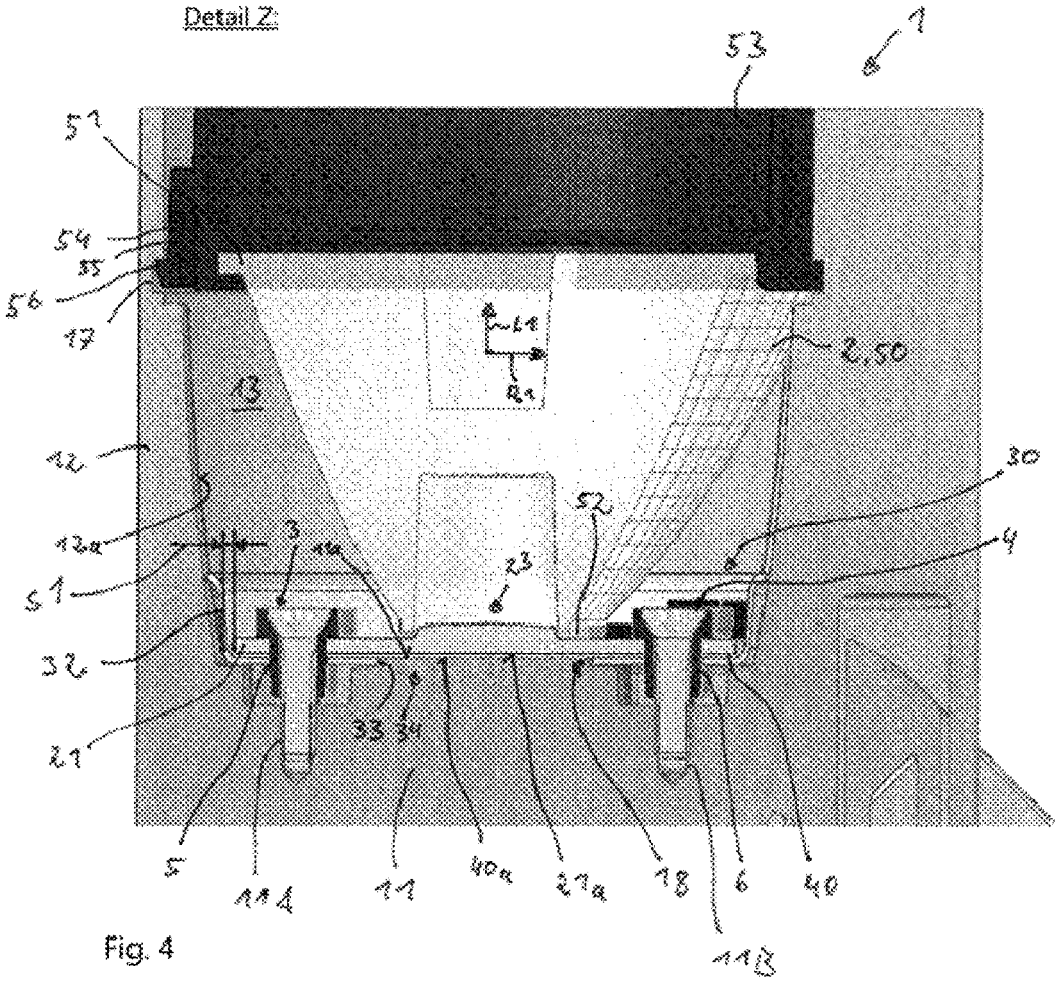
FIG. 4 is an enlarged view of the region characterised by the letter Z in FIG. 3.

As shown, in particular in FIGS. 1, 2 and 4, the lamp 1 has an insulation component 30 formed from an electrically insulating material. The insulation component 30 has a main portion 31, which extends in particular in a planar manner and is, for example, plate-shaped or disc-shaped, and an edging portion 32. The edging portion 32 extends from the main portion 31 and transversely thereto. The main portion 31 and the edging portion 32 thus form an insulation component 30, which is shell-shaped overall.

As shown by way of example in FIGS. 1 to 4, the main portion 31 of the insulation component 30 may have a recess 33. Said recess may for example be configured in a central region 34 of the main portion 31, wherein the central region 34, in a plan view of the main portion 31, may, for example, be provided by a region extending concentrically around the area centre of the main portion 31.

As shown by way of example in FIG. 4, the edging portion 32 of the insulation component 30 may have a curved cross-sectional course.

As shown in particular in FIGS. 1, 2 and 4, the main portion 31, in relation to the lamp longitudinal direction L1, is arranged between the end wall 11 and the lighting means device 20, and the edging portion 32, in relation to a radial direction R1 extending transversely to the lamp longitudinal direction L1, is arranged between the lighting means device 20 and the side wall 12 of the lamp housing 10.

The edging portion 32 therefore extends from the main portion 31 of the insulation component 30 transversely to the main portion 31 in such a way that the edging portion 32 is arranged between the lighting means device 20 and the side wall 12 of the lamp housing 10.

The edging portion 32 thus screens the lighting means device 20 in the radial direction R1 and the main portion 31 screens the lighting means device 20 in the lamp longitudinal direction L1 in relation to the lamp housing 10. As the insulation component 30 is formed from an electrically insulating material, leakage currents possibly flowing between the lamp housing 10 and the lighting means device 20, or possible electrical arcs, are advantageously prevented. In particular, the edging portion 32, in relation to the radial direction R1, allows a small side spacing s1 between the lighting means device 20 and the side wall 12, in particular between the lighting means device 20 and the internal face 12*a* of the side wall 12, without a current flow being produced between the lighting means device 20 and housing 10. A particularly compact structure of the lamp 10 is thus made possible.

As already described, the main portion 31 of the insulation component 30 may have a recess 33. It is for example provided here that the lighting means device 20 is arranged on the main portion 31 of the insulation component 30 in such a way that the lighting means region 23 of the lighting means carrier 21 and the recess 33 of the main portion 31 of the insulation component 30, in relation to the radial direction R1, at least partially overlap. In a plan view of the lighting means device 20 and the main portion 31 of the insulation component 30, for example in a plan view of a second surface 21*b* of the lighting means carrier 21, which faces the light outlet opening 16, the lighting means region 23 of the lighting means device 20, in relation to the radial direction R1, is for example situated entirely or at least partially within the recess 32.

This overlapping arrangement of the lighting means region 23 and the recess 33 of the main portion 31 has the advantage that the lighting means device 20 in the region of the recess 33 can emit heat unhindered, for example by radiation or convection, to the end wall 11 or an optionally provided heat conduction component 40 still to be described in detail below.

The recess 34 may furthermore, as shown by way of example in FIG. 4, be configured to centre the insulation component 30 on the end surface 11*a* of the end wall 11. For example, it may be provided that the end surface 11*a* forms a step 18 of the end wall 11. The insulation component 30 may then be arranged in the housing interior 13 in such a way that the recess 34 receives the step 18 of the end wall 11.

The insulation component 30 may, in particular, be formed from a polybutylene terephthalate material. Materials of this type have the advantage that they are economical and have good heat resistance, for example can also still be used at a temperature of more than 105 degrees Celsius.

Insulation components 30 can be produced using the aforementioned material in a particularly economical manner from a film-like material blank, for example by a vacuum forming process.

As already described in conjunction with the insulation component 30, the lamp 1 may additionally have a heat conduction component 40. The heat conduction component 40 is also formed from an electrically insulating material. In particular, the heat conduction component 40 may be configured as a component, which extends in a planar manner and is, in particular, plate-shaped or disc-shaped.

As shown by way of example in FIGS. 1 and 2, the heat conduction component 40, in relation to the lamp longitudinal direction L1, may be arranged between the insulation component 30 and the end wall 11 of the lamp housing 10. As an alternative to this, the heat conduction component 40, in relation to the lamp longitudinal direction L1 can also be arranged between the lighting means device 20 and the insulation component 30, as is shown in FIG. 4.

The heat conduction component 40 is advantageously formed from a material with high heat conductivity. In particular, the heat conduction component 40 may be formed from a soft, in particular resiliently deformable material. Furthermore, the heat conduction component 40 rests with at least a portion of a first contact surface 40*a* on the end surface 11*a* of the end wall 11. The heat conduction component 40, as shown in FIGS. 1 and 2, can rest with at least a portion of a second contact surface 40*b*, situated opposite the first contact surface 40*a*, on a first surface 31*a* of the main portion 31 of the insulation component. It may also be provided that the heat conduction component 40 rests with at least a portion of the second contact surface 40*b* or, as shown by way of example in FIG. 4, with the entire second contact surface 40*b* on a first surface 21*a* of the lighting means carrier 21.

Since the heat conduction component 40 rests with at least a portion of the first contact surface 40*a* on the end surface 11*a* of the end wall 11, a reliable and efficient heat transfer from the lighting means device 20 to the lamp housing 10 is ensured.

The heat conduction component 40 may, for example, have a thickness d40, in particular a cross-sectional thickness, in a range between 0.1 mm and 10 mm, for example between 0.2 mm and 5 mm and for example between 0.3 mm and 3 mm. In this range, a spacing of the lighting means device 20 in the lamp longitudinal direction L1 from the end wall 11 is achieved, in which, on the one hand, leakage currents between the lighting means device 20 and lamp housing 10 are reliably prevented. At the same time, the heat conduction component 40 in this thickness range has low thermal resistance, so that an efficient heat removal from the lighting means device 20 to the lamp housing 10 is also ensured.

FIGS. 1 and 2 show, by way of example, possible fastenings of the components arranged in the housing interior 13 on the lamp housing 10.

As shown in FIG. 1, the lighting means device 20 and the insulation component 30 may be connected to the end wall 11 of the lamp housing 10 by means of a clamping mechanism 2. In particular, it may be provided that the clamping mechanism 2 is prestressed between an attachment point 17, which is situated on the side wall 12 of the lamp housing 10, and the lighting means carrier 21 of the lighting means device 20.

The clamping mechanism 2 may, for example, be configured as a funnel-shaped component, which has resiliently deformable side walls 7. In this case, it may be provided that a first end portion 8 of the side wall 7 of the clamping mechanism 2 engages in an attachment point 17 configured as an indentation of the side wall 12 of the lamp housing 10 and a second end portion 9 of the side wall 7 of the clamping mechanism 2, which is situated opposite the first end portion 8, rests on a second surface 21*b* of the lighting means carrier 21. A variant of this type is shown by way of example in FIG. 1.

The attachment point 17 may also be configured as an elevation protruding in the radial direction R1 from the side wall 12 of the lamp housing 10, on the lower underside of which elevation facing the end surface 11*a*, in relation to the lamp longitudinal direction L1, the first end portion 8 of the side wall 7 of the clamping mechanism 2 rests.

The attachment point 17 may also be formed by a thread configured on the internal surface 12*a* of the side wall 12 of the lamp housing 10. In this case, the first end portion 8 of the clamping mechanism 2 or an adapter component 53 receiving it has a corresponding counter-thread, which can be screwed into the thread of the side wall 12.

The attachment point 17, in relation to the lamp longitudinal direction L1, is generally situated spaced apart from the end surface 11*a*. In particular, the attachment point 17 is situated, in relation to the lamp longitudinal direction L1, between the light outlet opening 16 and an end portion 35 of the edging portion 32 of the insulation component 30 situated spaced apart from the main portion 31.

Instead of a funnel-shaped component, the clamping mechanism 2 can also be formed by a plurality of resiliently deformable rod-shaped components, which in each case engage with a first end portion on the attachment point 17 and rest with a second end portion situated opposite the first end portion on the second surface 21*b* of the lighting means carrier 21.

Figure 3:
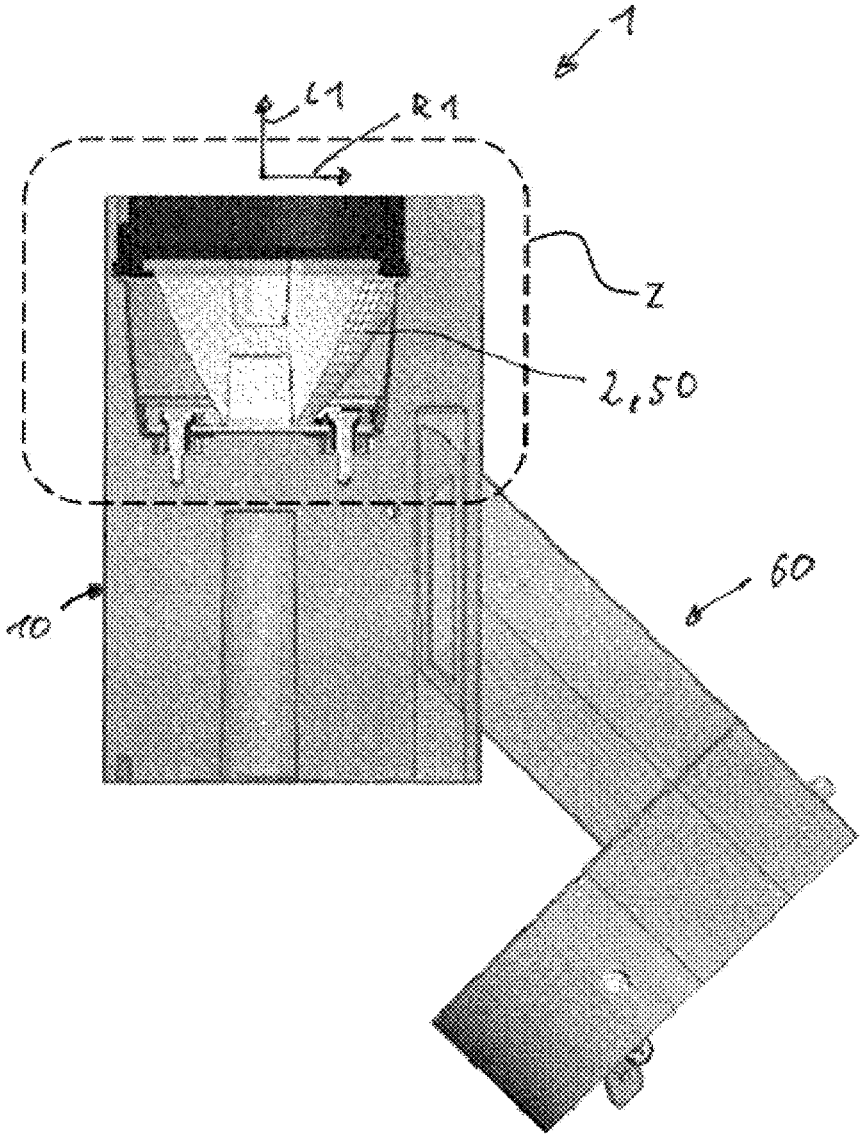
FIG. 3 is an external view of a lamp according to an embodiment of a lamp of the present invention, a lamp housing of the lamp being shown partially transparent.

Furthermore, the clamping mechanism 2 can also be configured as a lens device 50, as shown by way of example in FIGS. 3 and 4. The lens device 50 has a first end portion 51, which is received with an interlocking fit in an adapter component 53. The adapter component 53 has a latching portion 54 protruding therefrom in the radial direction R1, said latching portion being formed by a resiliently deformable yoke 55 and a latching jaw 56, the latching jaw 56 engaging in the attachment point 17, which is configured in this case as a recess. As an alternative to this, the attachment point 17 can also be formed by a thread configured on the internal surface 12*a* of the side wall 12 of the lamp housing 10 and the adapter component 53 can have a corresponding counter-thread, which can be screwed into the thread of the side wall 12.

As an alternative or in addition to a fastening of the components arranged in the housing interior 13 on the lamp housing 10 by means of a clamping mechanism 2, it may be provided that the lighting means device 20 and the insulation component are connected to the end wall 11 of the lamp housing 10 by means of fastening elements 3, 4 extending through the lighting means carrier 21 and the main portion 31 of the insulation component 30, and optionally through the heat conduction component 40, as shown by way of example in FIG. 2. In FIGS. 2 and 4, the fastening elements 3, 4 are shown by way of example as screws. The fastening elements 3, 4 may also, however, be realized as rivets, pins or the like.

The fastening elements 3, 4 generally in each case have an elongate shaft 3A, 4A, which extends through corresponding through-holes 20A, 20B, 30A, 30B, 40A, 40B formed in the lighting means carrier 20, the insulation component 30 and optionally the heat transfer part 40 and is received with an interlocking fit and/or a force fit in a corresponding fastening recess 11A, 11B formed in the end wall 11. The fastening elements 3, 4 furthermore in each case have a head 3B, 4B, which is connected to the shaft 3A, 3B, which head, as a result of the interlocking and/or force fit of the shaft 3A, 4A in the fastening recess 11A, 11B, presses against the second surface 21B of the lighting means carrier 21.

The fastening elements 3, 4, on the one hand, bring about a fastening of the lighting means carrier 20, the insulation component 30 and optionally the heat transfer part 40 on the end wall 11. If the lamp 1 has a heat transfer part 40, the fastening elements 3, 4 also bring about a deformation of the heat transfer part 40 and therefore increase the size of the adjacent regions of the surfaces 40*a*, 40*b* of the heat transfer part 40, which is advantageous with regard to heat removal from the lighting means device 20 to the lamp housing 10.

As shown in FIGS. 3 and 4, the screw connection can also be provided in addition to fastening by means of a clamping mechanism 2.

As shown in FIGS. 2 to 4, the fastening elements 3, 4 are edged in each case by an insulation sleeve 5, 6. The insulation sleeves 5, 6 are in each case formed from an electrically insulating material and ensure that no electrically conductive connection can occur between the fastening elements 3, 4 and the lighting means carrier 21.

As shown by way of example in FIG. 3, the lamp 1 may have a holding device 60, by means of which the lamp 1 can be fastened to a connection point (not shown). The connection point may be formed, for example, by a floor structure or a wall of a building or a rail attached thereto.

The invention claimed is:

1. A lamp, comprising:

a lamp housing, having an end wall and a side wall, wherein the end wall and the side wall form a housing interior;

a lighting means device arranged in the housing interior having a lighting means carrier and at least one lighting means arranged thereon;

an insulation component formed from an electrically insulating material having a main portion and an edging portion, the main portion being arranged between the end wall and the lighting means device and the edging portion extending from the main portion, transversely thereto, in such a way that the edging portion is arranged between the lighting means device and the side wall of the lamp housing; and a heat conduction component, which is formed from an electrically insulating material and is arranged between the lighting means device and the insulation component or between the insulation component and the end wall of the lamp housing.

2. The lamp according to claim 1, wherein the main portion of the insulation component comprises a recess and the lighting means device is arranged on the main portion of the insulation component in such a way that a lighting means region of the lighting means carrier, in which the at least one lighting means is arranged, and the recess of the main portion of the insulation component at least partially overlap.

3. The lamp according to claim 1, wherein the edging portion of the insulation component has an at least partially curved cross-sectional course.

4. The lamp according to claim 1, wherein the lighting means device and the insulation component are connected by means of a clamping mechanism to the end wall of the lamp housing, wherein the clamping mechanism is prestressed between an attachment point, which is situated on the side wall of the lamp housing, and the lighting means carrier of the lighting means device.

5. The lamp according to claim 1, wherein the lighting means device and the insulation component are connected to the end wall of the lamp housing by means of fastening element extending through the lighting means carrier and the main portion of the insulation component, wherein the fastening element are edged by an insulation sleeve.

6. The lamp according to claim 1, wherein the insulation component is formed from a polybutylene terephthalate material.

7. The lamp according to claim 1, wherein the heat conduction component has a thickness in a range between 0.1 mm and 10 mm.

8. The lamp according to claim 1, wherein the heat conduction component has a thickness in a range between 0.2 mm and 5 mm.

9. The lamp according to claim 1, wherein the heat conduction component has a thickness in a range between 0.3 mm and 3 mm.

10. The lamp according to claim 1, wherein the at least one lighting means is integrated on the lighting means carrier in such a way that the lighting means device is configured as a chip-on-board LED module.

11. The lamp according to claim 1, wherein the at least one lighting means is integrated on the lighting means carrier in such a way that the lighting means device is configured as a PCBA-LED module.

12. The lamp according to claim 1, wherein the lighting means device is designed so that it can be operated by an operating voltage of greater than 90 volts.

13. The lamp according to claim 1, wherein the lighting means device is designed so that it can be operated by an operating voltage equal to 90 volts.

14. A lamp comprising:

a lamp housing, having an end wall and a side wall, wherein the end wall and the side wall form a housing interior;

a lighting means device arranged in the housing interior having a lighting means carrier and at least one lighting means arranged thereon;

an insulation component formed from an electrically insulating polybutylene terephthalate material having a main portion and an edging portion, the main portion being arranged between the end wall and the lighting means device, and the edging portion extending from the main portion, transversely thereto, in such a way that the edging portion is arranged between the lighting means device and the side wall of the lamp housing.

* * * * *